US005894796A

United States Patent [19]

Gelinas

[11] Patent Number: 5,894,796

[45] Date of Patent: Apr. 20, 1999

[54] PRINTING UNIT FOR A WEB-FED ROTARY PRINTING PRESS

[75] Inventor: Wilfried Robert Gelinas, Jewett City, Conn.

[73] Assignee: Heidelberger Druckmaschinen AG, Germany

[21] Appl. No.: 08/905,111

[22] Filed: Aug. 1, 1997

[51] Int. Cl.[6] ..... B41F 5/04; B41F 13/10

[52] U.S. Cl. ..... 101/219; 101/375; 101/479; 29/895.23; 492/15

[58] Field of Search ..... 101/212, 216, 101/218, 219, 375, 479, 181; 29/895, 895.2, 895.23; 492/15

[56] References Cited

U.S. PATENT DOCUMENTS

| | | | |
|---|---|---|---|
| 637,579 | 11/1899 | Hett | 101/479 |
| 2,940,388 | 6/1960 | Shaefer | 101/375 |
| 3,148,616 | 9/1964 | Mieslak | 101/375 |
| 3,529,545 | 9/1970 | Gartside | 101/219 |
| 3,952,397 | 4/1976 | Lohr | 101/375 |
| 4,217,821 | 8/1980 | Vertegaal | 101/181 |
| 5,036,766 | 8/1991 | Songer | 101/375 |
| 5,047,808 | 9/1991 | Landa et al. | 101/375 |
| 5,241,905 | 9/1993 | Guaraldi et al. | 101/216 |
| 5,289,769 | 3/1994 | Lewis | 101/218 |
| 5,481,973 | 1/1996 | Schmid | 101/216 |
| 5,537,923 | 7/1996 | Boor et al. | 101/479 |
| 5,601,021 | 2/1997 | Katabira et al. | 101/218 |

*Primary Examiner*—Eugene H. Eickholt
*Attorney, Agent, or Firm*—Kenyon & Kenyon

[57] ABSTRACT

A printing unit for a web-fed rotary printing press comprises a housing defining a first side wall in which a drive mechanism is mounted and a second side wall in which a locking mechanism is mounted. A blanket cylinder including a plurality of holes extending axially therethrough, and being releasably mounted between the first and second side walls includes an endless tubular printing blanket mounted around an external surface thereof. A first end-cap affixed to a first end portion of the blanket cylinder is drivingly coupleable to the drive mechanism so that torque generated by the drive mechanism is transmitted via the first end-cap to the blanket cylinder to rotate the blanket cylinder about the axis. A second end-cap is selectively coupleable to the locking mechanism so that, when the locking mechanism is in a locking configuration, the blanket cylinder is constrained to rotate about the axis and, when the locking mechanism is in a second release position, the second end portion of the blanket cylinder is free from constraint and the blanket cylinder may be removed from the housing.

19 Claims, 6 Drawing Sheets

50
68
70
79
78
74
72
66
56
10
54
52
62
76
60
64
24
28
58
4
6

PRINTING UNIT FOR A WEB-FED ROTARY PRINTING PRESS

FIELD OF THE INVENTION

The present invention relates to a printing unit for a web-fed rotary printing press having a removable, light weight blanket cylinder carrying an endless printing blanket.

BACKGROUND OF THE INVENTION

In the field of printing presses, in particular in the field of web-fed rotary printing presses, it is desired to reduce press downtime which occurs, for example, when exchanging the printing blanket on the blanket cylinders of the press. Over time, the printing operation results in deterioration of the printing blankets causing a corresponding decrease in the quality of the printed image. Of course, when the quality of the printed image has deteriorated beyond an acceptable level, the blankets must be replaced. In addition, printing blankets may be damaged by objects passing through any of the nips between, for example, the blanket cylinder and the plate cylinder or between two associated blanket cylinders in a perfecting unit for printing on both sides of a running web. Furthermore, after a web break, one end of the torn web may become wrapped around a blanket cylinder forming a hardened layer of ink and paper. Thus, the printing blankets must be removed so that the hardened layer of ink and paper may be mechanically removed afterwards.

More recently, high speed web-fed rotary printing presses have used blanket cylinders carrying removable tubular endless printing blankets. These gapless blanket cylinders have improved printing quality at high speeds by reducing vibrations and impact forces resulting from the asymmetrical construction of conventional grooved cylinders which excite the bending forces on the cylinders.

U.S. Pat. No. 2,949,852 describes an undriven lightweight printing roll for a printing press having a tubular body of extruded aluminum. End caps having cone-shaped recesses for receiving cone-shaped shaft end members are formed at the ends of the tubular body. The shaft is rigidly attached to the printing roll which is rotatably supported by side walls of a housing of the printing press.

DE 44 42 575 C1 purports to describe a mechanism for coupling a removable solid cylinder of a printing press to a drive gear, wherein the drive gear remains in the housing of the printing press after the removal of the cylinder. A shaft which is axially movable by means of a pneumatic cylinder coupled to one end thereof extends through the center of the drive gear to rotatably couple the solid cylinder to the drive gear. The other end of the shaft acts upon a toothed collar drivingly connected to the drive gear which, in turn, engages a second toothed collar formed at an adjoining end portion of the solid cylinder.

SUMMARY OF THE INVENTION

It is an object of the present invention to provide a printing unit for a web-fed rotary printing press which is capable of providing high quality printing at high press speeds, which is simple in construction and which reduces downtime associated with the replacement of damaged printing blankets.

The present invention is directed to a printing unit for a web-fed rotary printing press comprising a housing defining a first side wall in which a drive mechanism is mounted and a second side wall in which a locking mechanism is mounted. A blanket cylinder including a plurality of holes extending axially therethrough, and being releasably mounted between the first and second side walls includes an endless tubular printing blanket mounted around an external surface thereof. A first end-cap affixed to a first end portion of the blanket cylinder is drivingly coupleable to the drive mechanism and a second end-cap is selectively coupleable to the locking mechanism in the second side wall of the housing.

Pursuant to an alternate embodiment of the invention, the holes in the blanket cylinder may have a substantially trapeziform cross-section. The side walls of each of the holes may extend substantially radially and may have a thickness of approximately 1.8 cm.

According to a preferred embodiment of the invention, the tubular blanket cylinder body is formed of extruded aluminum with a ratio of an inner diameter to an outer diameter in a range of 1:2 to 1:3.

More specifically, the drive mechanism for driving the blanket cylinder comprises a drive shaft rotatably supported in the first side wall of the housing and extending from a drive gear formed at a first end thereof to a second end drivingly coupled to a first end cap. The connection between the first end cap and the drive shaft is preferably a groove-key-connection.

According to a further embodiment of the invention, the locking mechanism for engaging the second end-cap of the blanket cylinder includes a shaft which is rotatably supported in and axially slidable with respect to the second side wall. In a first position, an end portion of the shaft extends into a central axial hole formed in the second end cap to rotatably support the blanket cylinder and, in a second position the shaft is completely retracted from the end cap so that the blanket cylinder may be removed from the printing unit. The locking mechanism may preferably comprise a force transmitting element rotatably connected to the slidable shaft and a force applying element acting on the force transmitting element to move the shaft between the first and second positions.

The force applying element of this embodiment may be formed as a lever acting on the force transmitting element, wherein the lever is pivotally supported at a projection of the second side wall of the housing. In addition, an annular portion of increased diameter may be provided at the slidable shaft to limit the movement of the end portion into the second end cap. In this embodiment, it may also be advantageous to provide a ring-shaped resilient element, which may be formed of rubber, between the increased diameter annular portion and the second end-cap.

BRIEF DESCRIPTION OF THE DRAWINGS

The present invention, together with additional objects and advantages thereof will be best understood from the following detailed description when read in connection with the accompanying drawings, in which.

DETAILED DESCRIPTION

Figure 1:
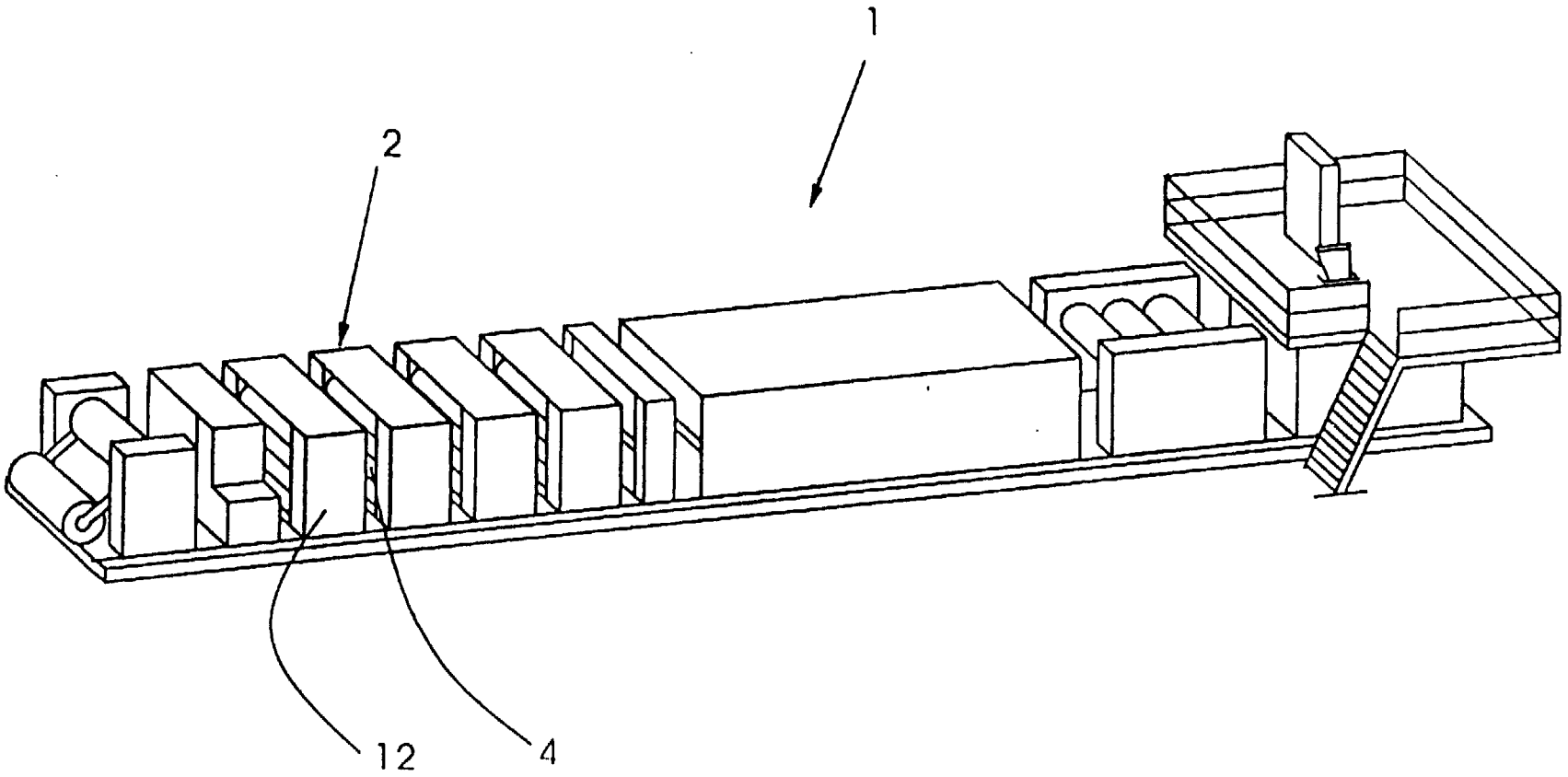
FIG. 1 shows a printing press including a printing unit according to the present invention.
Figure 2:
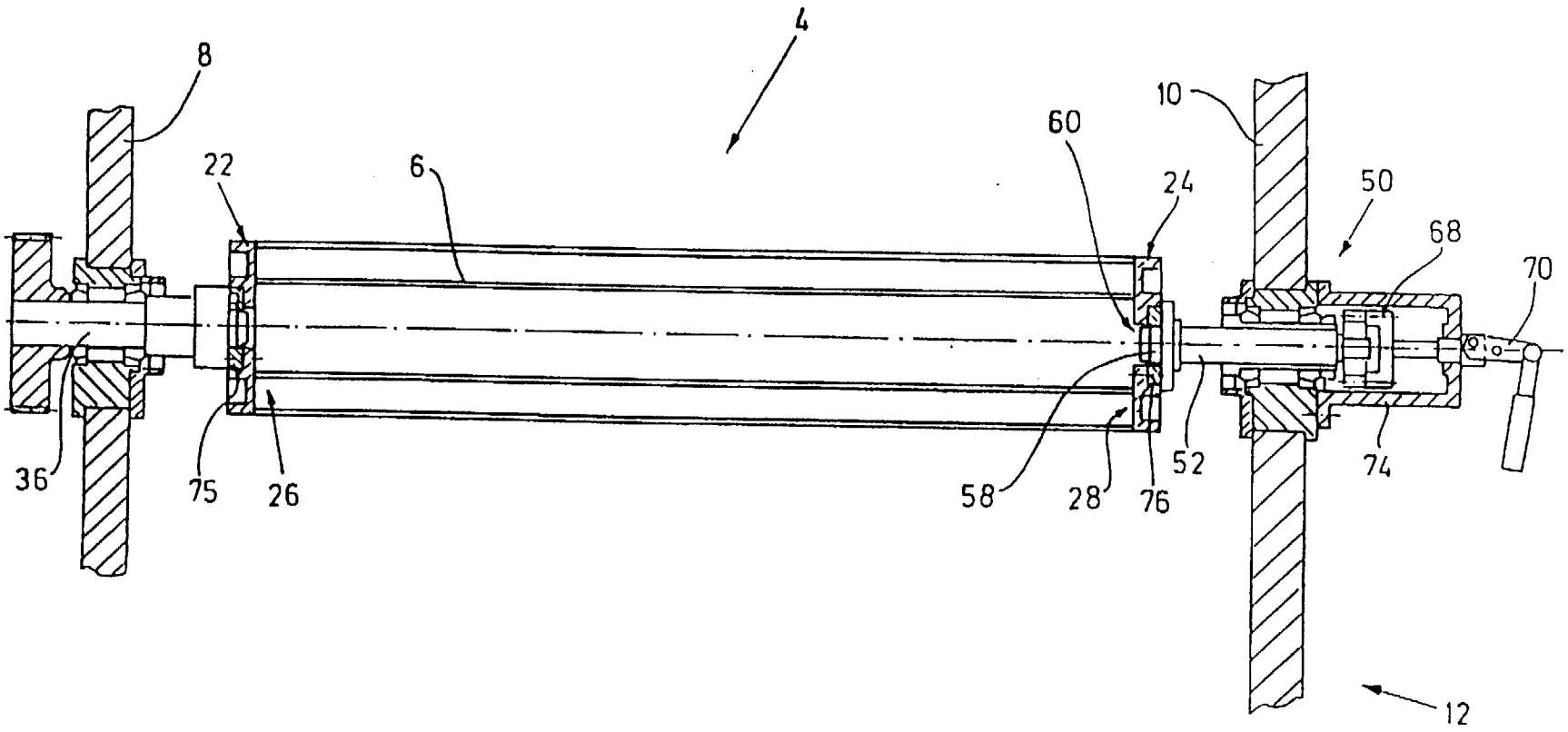
FIG. 2 shows a top view of a printing unit according to the present invention, in which the blanket cylinder is rotatably supported in first and second side walls of the housing.

As shown in FIGS. 1 and 2, a lithographic web-fed rotary printing press 1 comprises a plurality of printing units 2, each having a housing 12 with at least one blanket cylinder 4, rotatably supported therein. Each blanket cylinder 4 includes a tubular blanket cylinder body 6 rotatably supported in both first and second side walls 8 and 10, respectively, of the housing 12, with an endless printing blanket 14 mounted on an external surface of the blanket cylinder body 6. The printing blanket 14 is preferably firmly attached to the external surface of the blanket cylinder body 6 by means of glue or vulcanizing, for example. Or, as described above, the endless blanket 14 may be mounted on the blanket cylinder body 6 by expanding a tubular blanket having a smaller diameter than the diameter of the blanket cylinder body 6 by means of, for example, blast air and moving the expanded blanket 14 onto the blanket cylinder body 6. After switching off the blast air, the printing blanket 14 contracts and tightly clamps onto the tubular body 6. As is known in the art, the printing blanket 14 may be made of materials including rubbers and plastics and may be reinforced by an inner layer of aluminum or other metal.

Figure 4:
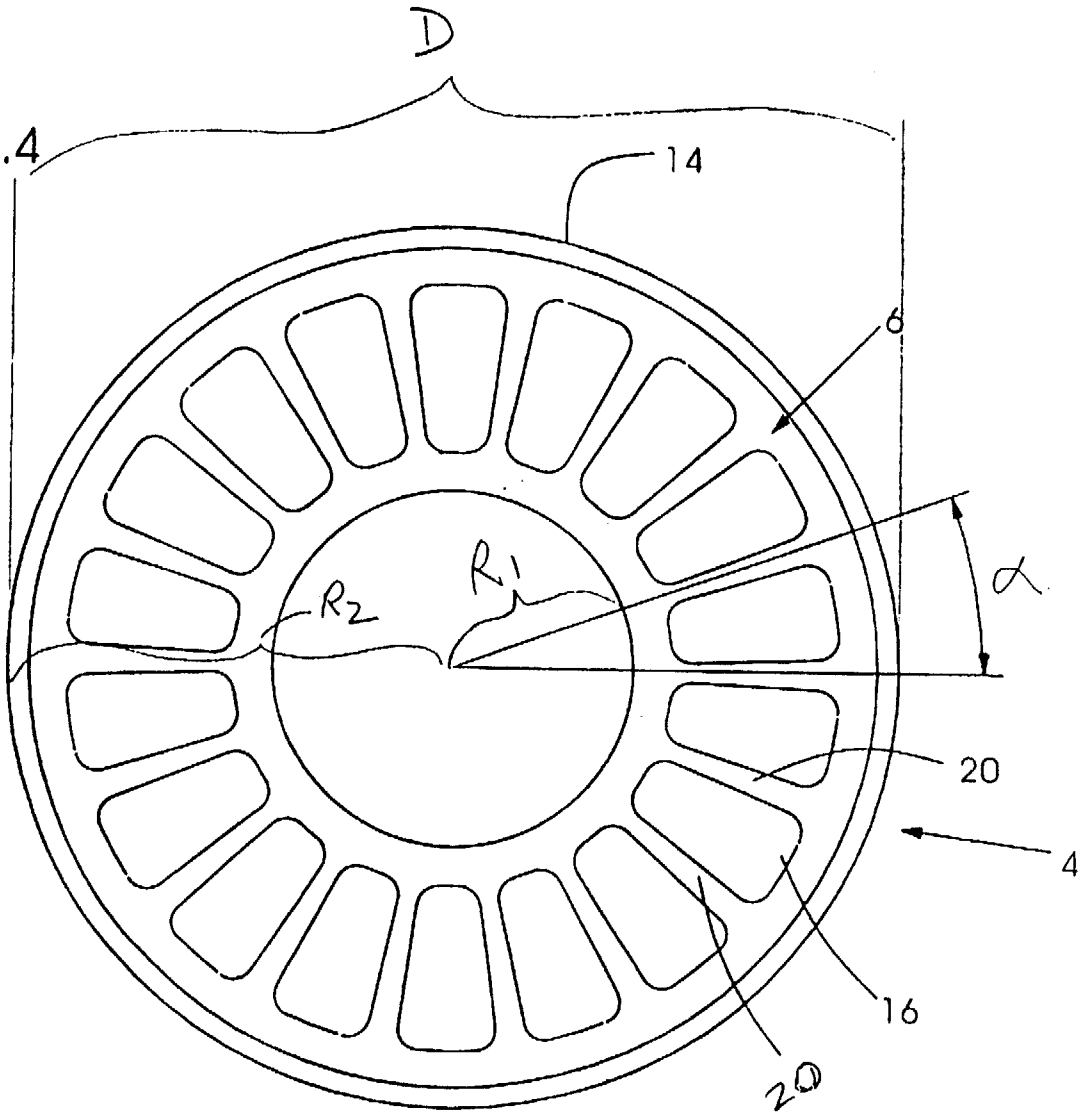
FIG. 4 is a schematic cross-sectional view of a blanket cylinder according to a first embodiment of the present invention.

As shown in FIG. 4, the blanket cylinder body 6 may be formed of extruded aluminum comprising axially extending holes 16, which preferably extend across the entire width of the blanket cylinder body 6. The holes 16 may preferably have a substantially trapezoidal cross-section, with the side walls which define each hole 16 extending substantially radially from the axis of rotation of the blanket cylinder body 6. Alternatively, the holes 16 may have a substantially circular or elliptical cross-section. As shown in FIG. 4, the holes 16 may preferably be arranged symmetrically about the axis of rotation of the cylinder body 6, equidistantly spaced from each other with the holes 16 being sized so that each hole 16 covers an angle $\alpha$ of approximately 20°. That is, there are preferably approximately 18 holes 16 arranged around the circumference of the cylinder body 6. In addition, for a blanket cylinder 4 having a diameter of approximately 65 cm, the side walls 20 defined between neighboring holes 16 will preferably between 1.6 and 1.95 cm thick and will more preferably be approximately 1.8 to 1.875 cm thick. That is, the thickness of the walls 20 will preferably be between 2.5% and 3% of the diameter D of the blanket cylinder 4 and will more preferably be approximately 2.8% of D. As may also be seen from FIG. 4, the ratio of an inner diameter $R_1$, and an outer diameter $R_2$ of the tubular body 6 is most preferably approximately 1:2.5, but may also be in the range between 1:2 and 1:3.

Figure 3:
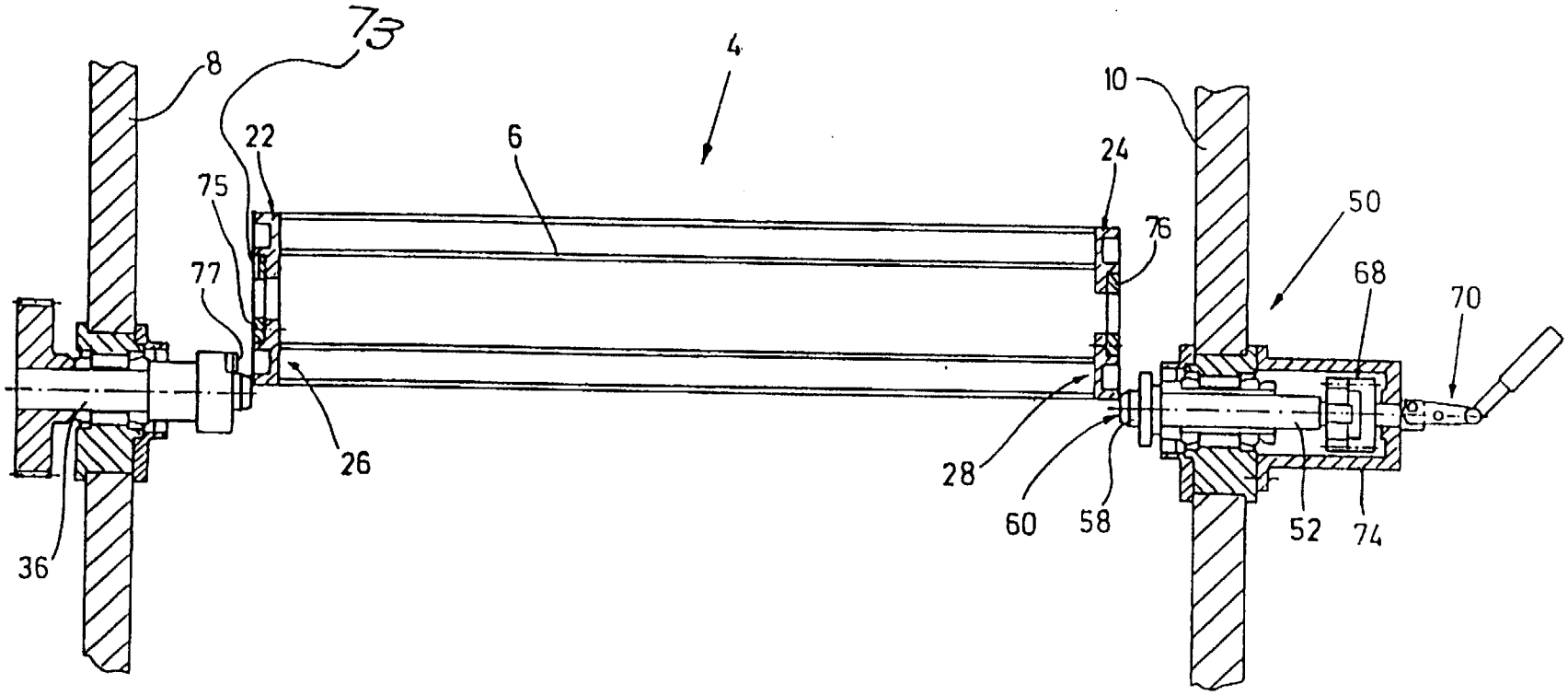
FIG. 3 is a schematic view of the printing unit of FIG. 2 in which the rotatable support of the blanket cylinder has been disengaged and the cylinder has been partially removed.
Figure 5:
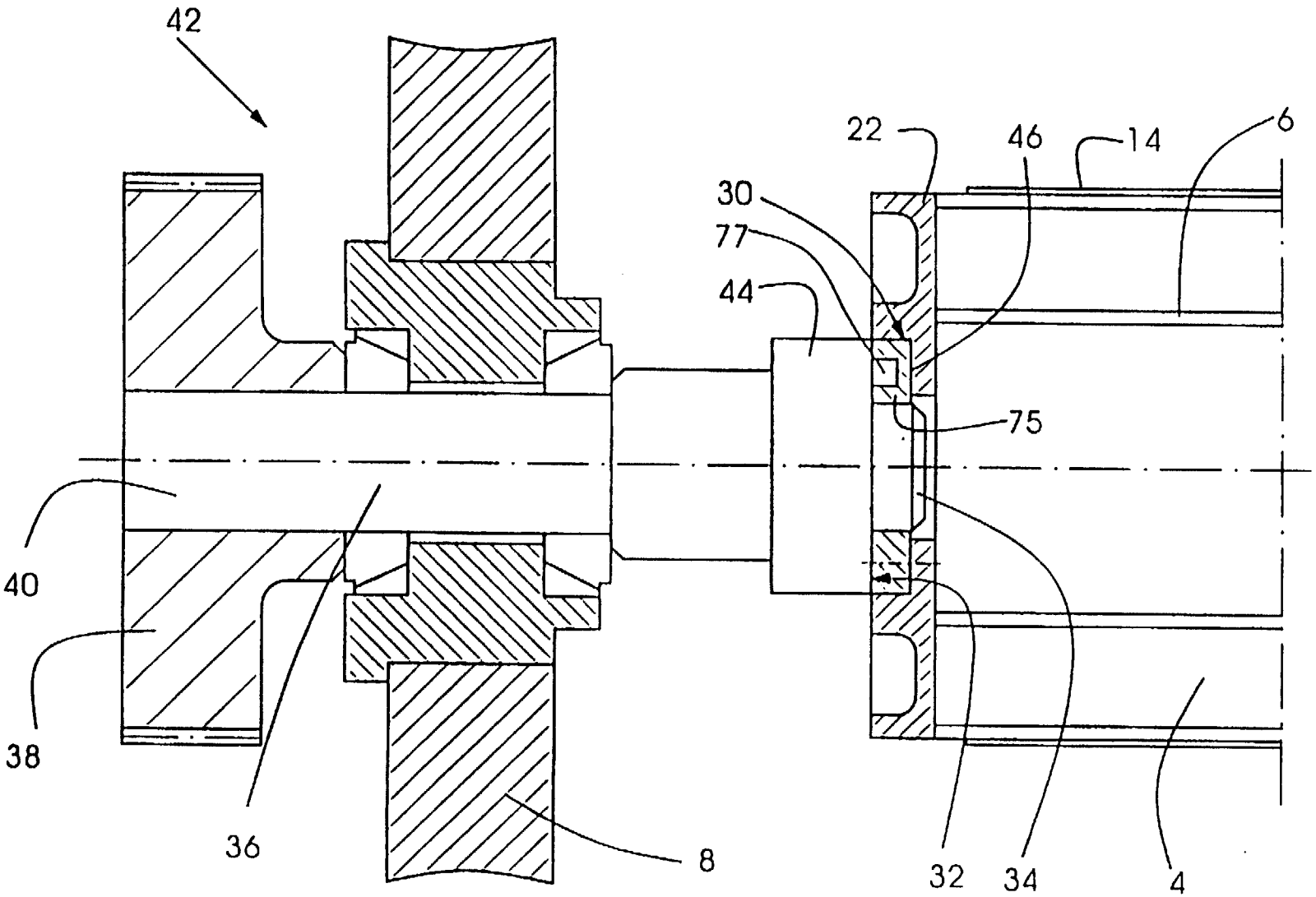
FIG. 5 is an enlarged schematic view of the drive mechanism of the printing unit of FIG. 2.

Referring now to FIGS. 2 and 3, first and second end-caps 22 and 24 are shown mounted at first and second end portions 26, 28, respectively, of the cylinder body 6. As shown more clearly in FIG. 5, an engaging portion 30 of the first end-cap 22 engages a corresponding engaging portion 32 formed at a first end 34 of a drive shaft 36. The drive shaft 36 is rotatably supported in the first side wall 8 of the housing 12 and is driven by a drive gear 38 which is arranged at a second end 40 of the drive shaft 36 outside the housing 12. The engaging portion 30 and the engaging portion 32 may preferably include one or more grooves 73 and associated keys 77 forming a groove-key connection for transmitting torque from the drive shaft 36 to the first end-cap 22 so that, upon rotation of the drive shaft 36, the cylinder 4 is also rotated. Those skilled in the art will understand that, although the keys 77 of this embodiment are shown projecting from the engaging portion 32 while the grooves 73 are formed in the engaging portion 30, that this arrangement may be reversed without altering the function of the coupling. The position and orientation of the grooves 73 and associated keys 77 formed in the engaging portions 30 and 32 is preferably such that there is only one possible position for properly coupling the end-cap 22 of the blanket cylinder 4 to the drive shaft 36. The drive shaft 36 together with the drive gear 38 and the engaging portion 32 form a drive mechanism 42 for driving the blanket cylinder 4. As may be seen from FIG. 5, the drive shaft 36 is preferably rotatably supported within the first side wall 8 of the housing 12 such that the drive shaft 36 is axially fixed and not moveable relative to the first side wall 8 when an axial load is applied to the engaging portion 32, e.g. by the blanket cylinder 4. Furthermore, a collar 44 may be formed at the first end 34 of the drive shaft 36 to provide for a precise alignment of the drive shaft 36 and the blanket cylinder 4. As shown in FIG. 5, an insert 75 of rigid material, preferably steel, may also be provided at the first end-cap 22. The insert 75 is preferably received within a circular recess 46 of the end-cap 22 and comprises a hole for receiving an associated key 77 formed at the collar 44 of the drive shaft 36.

Figure 6:
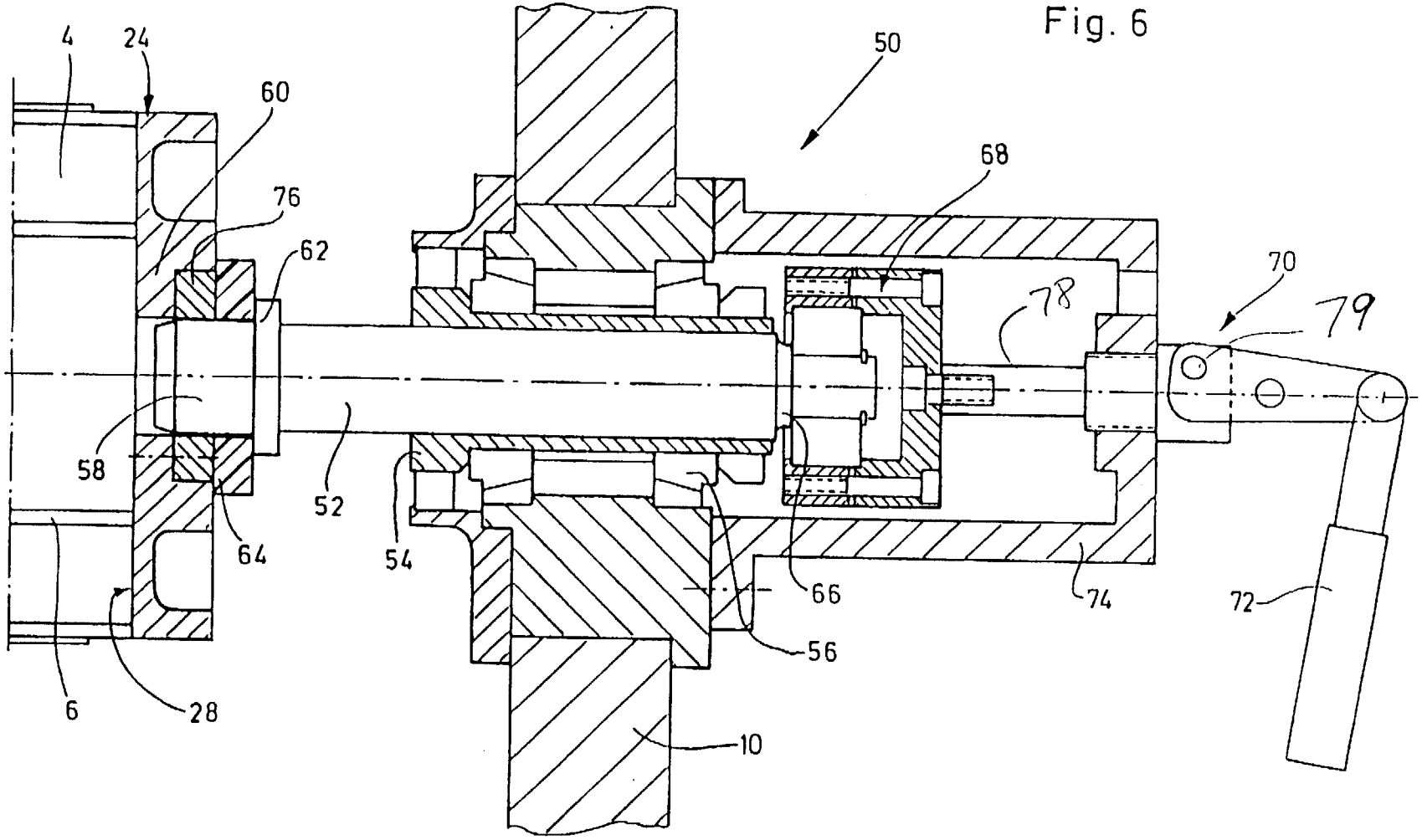
FIG. 6 is an enlarged schematic view of the locking mechanism of the printing unit of FIG. 2 wherein the locking mechanism is in a first position.

As shown in FIG. 6, the printing unit 2 comprises a locking mechanism 50 arranged in the second side wall 10 of the housing 12 which provides a precise rotatable support of the blanket cylinder 4 yet, which allows easy and quick replacement of the blanket cylinder 4. The locking mechanism 50 comprises a shaft 52 which is axially slidable or movable within a sleeve 54 toward and away from the first side wall 8. The sleeve 54 is rotatably supported in the second side wall 10 of the housing 12 by bearings 56. The shaft 52 comprises an end portion 58 which, when the shaft 52 is in a first position as shown in FIG. 6, is received in an associated central axial hole 60 formed in the second end-cap 24. The shaft 52 may preferably include an annular portion 62, having a diameter larger than a diameter of the central axial hole 60. In addition, as shown in FIG. 6, a ring-shaped resilient element 64 may optionally be provided between the annular portion 62 and the outer surface of the second end-cap 24 to transmit a resilient axial load from the shaft 52 to the second end-cap 24 when the shaft 52 is in the first position. The ring-shaped resilient element 64 may preferably be a rubber spring ring which will allow cylinder bodies 6 to be mounted into the printing unit 2 without a respective adjustment of the locking mechanism 50 even if the cylinder bodies 6 vary slightly in length. In addition, as shown in FIG. 6, an insert 76 formed of a rigid material, e.g. steel, may also be provided in the second end-cap 24 so that it surrounds the end portion 58 of the shaft 52. The insert 76 is preferably ring-shaped and sized to slidably receive the end portion 58 of the shaft 52 therein.

As shown in FIG. 6, the second end portion 66 of the shaft 52 may preferably be rotatably connected to a force transmitting element 68 which transmits an axial force onto the shaft 52 for moving the shaft 52 from the first position shown in FIG. 6 into a second position shown in FIG. 3 in which the shaft 52 is completely retracted from the blanket cylinder 4 so that the blanket cylinder 4 may be freely removed from the housing 12. A force applying element 70 in form of a lever 72, pivotally supported at a projection 74 formed at the second side wall 10, is coupled to the force transmitting element 68 via a shaft 78 so that as the lever 72 is rotated about the pivot point 79 counter-clockwise as shown in FIG. 6, the shaft 78 and, consequently, the force transmitting element 68 are moved left to right as shown in FIG. 6. Thus, the end portion 58 of the shaft 52 is drawn out of the central axial hole 60 and the blanket cylinder 4 may be removed from the housing 12. Of course, the force applying element 70 may alternatively be a pneumatic cylinder, an electrically or manually operated spindle drive, or any other suitable manual or powered force transmission assembly which is connected to the force transmitting element 68 so long as the assembly maintains precise rotatable support of the shaft 52 and, consequently, the blanket cylinder 4 and allows easy release of the cylinder 4.

It will be appreciated by those skilled in the art that the above described embodiments of the present invention are illustrative in nature and that various modifications and alterations may be made to the disclosed apparatus without departing from the teaching of the present invention, the scope of which is intended to be limited only by the claims appended hereto.

What I claim is:

1. A printing unit for a web-fed rotary printing press comprising:

a housing defining a first side wall in which a drive mechanism is mounted and a second side wall in which a locking mechanism is mounted;

a blanket cylinder defining an axis and including a plurality of holes extending axially therethrough;

an endless tubular printing blanket mounted around an external surface of the blanket cylinder;

a first end-cap affixed to a first end portion of the blanket cylinder, the first end-cap being drivingly coupleable to the drive mechanism;

a second end-cap affixed to a second end portion of the blanket cylinder, the second end-cap being selectively coupleable to the locking mechanism.

2. The printing unit of claim 1, wherein the holes formed axially through the blanket cylinder are substantially trapezoidal in cross-section in a plane substantially perpendicular to the axis.

3. The printing unit of claim 2, wherein the holes are arranged around the axis substantially equidistant from each other.

4. The printing unit of claim 3, wherein side walls defined between adjacent holes extend substantially radially from the axis.

5. The printing unit of claim 4, wherein at least one of the side walls has a thickness of between 1.6 and 1.9 cm.

6. The printing unit of claim 5, wherein the at least one side wall has a thickness of approximately 1.8 cm.

7. The printing unit of claim 1, wherein the blanket cylinder is formed of extruded aluminum.

8. The printing unit of claim 1, wherein a ratio of an inner diameter of the blanket cylinder to an outer diameter of the blanket cylinder lies in a range between 1:2 and 1:3.

9. The printing unit of claim 8, wherein the ratio of the inner diameter to the outer diameter of the blanket cylinder is approximately 1:2.5.

10. The printing unit of claim 1, wherein the drive mechanism comprises a drive shaft rotatably supported in the first side wall of the housing, the drive shaft having a first end portion with a drive gear mounted thereon and a second end portion drivingly coupleable to the first end-cap.

11. The printing unit of claim 10, wherein the drive shaft is drivingly coupleable to the first end-cap by means of a groove-key connection.

12. The printing unit of claim 10, wherein the first end of the drive shaft comprises a collar which, when the drive shaft is drivingly coupled to the first end-cap, is received in a corresponding circular recess formed in the first end-cap.

13. The printing unit of claim 1, wherein the locking mechanism comprises a locking shaft rotatably supported in and axially slidable relative to the second side wall from a first locking position in which an end portion of the locking shaft extends into a central axial hole formed in the second end-cap to rotatably support the blanket cylinder to a second release position in which the locking shaft is retracted from the central axial hole to release the second end portion of the blanket cylinder so that the blanket cylinder may be removed from the printing unit.

14. The printing unit of claim 13, wherein the locking mechanism includes a force transmitting element rotatably connected between the locking shaft and a force applying element for moving the locking shaft between the first and second positions.

15. The printing unit of claim 13, wherein the force applying element includes a lever pivotally supported at a projection of the second side wall, wherein rotation of the lever about the pivotal support moves the locking shaft between the first and second positions.

16. The printing unit of claim 11, wherein the locking shaft includes an abutting portion an outer diameter of which is increased relative to a non-abutting portion of the locking shaft to limit the axial movement of the end portion of the locking shaft when the locking shaft is moved into the first position.

17. The printing unit of claim 16, further comprising a ring-shaped resilient element coupled to the locking shaft so that, when the locking shaft is in the first position, the resilient element is located between the abutting portion and the second end-cap.

18. The printing unit of claim 17, wherein the resilient element is formed as an annular rubber spring.

19. A printing unit for a web-fed rotary printing press comprising:

a housing defining a first side wall in which a drive mechanism is mounted and a second side wall in which a locking mechanism is mounted;

a blanket cylinder defining an axis and including a plurality of holes extending axially therethrough;

an endless tubular printing blanket mounted around an external surface of the blanket cylinder;

a first end-cap affixed to a first end portion of the blanket cylinder, the first end-cap being drivingly coupleable to the drive mechanism so that, when the first end-cap is drivingly coupled to the drive mechanism, torque generated by the drive mechanism is transmitted via the first end-cap to the blanket cylinder to rotate the blanket cylinder about the axis;

a second end-cap affixed to a second end portion of the blanket cylinder, the second end-cap being selectively coupleable to the locking mechanism so that, when the locking mechanism is in a first locking configuration, the blanket cylinder is constrained to rotate about the axis and, when the locking mechanism is in a second release position, the second end portion of the blanket cylinder is free from constraint and the blanket cylinder may be removed from the housing.

* * * * *